US008672463B2

(12) United States Patent
Essen et al.

(10) Patent No.: US 8,672,463 B2
(45) Date of Patent: Mar. 18, 2014

(54) BYPASS FLUID CIRCULATION IN FLUID EJECTION DEVICES

(71) Applicant: FUJIFILM Corporation, Tokyo (JP)

(72) Inventors: Kevin von Essen, San Jose, CA (US); Paul A. Hoisington, Hanover, NH (US)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/793,416

(22) Filed: Mar. 11, 2013

(65) Prior Publication Data

US 2013/0293641 A1 Nov. 7, 2013

Related U.S. Application Data

(60) Provisional application No. 61/641,137, filed on May 1, 2012.

(51) Int. Cl.
*B41J 2/18* (2006.01)

(52) U.S. Cl.
USPC ..... 347/89

(58) Field of Classification Search
USPC ..... 347/84, 85, 89, 93
See application file for complete search history.

(56) References Cited

U.S. PATENT DOCUMENTS

| | | | | |
|---|---|---|---|---|
| 4,404,566 | A * | 9/1983 | Clark et al. | 347/89 |
| 2005/0151798 | A1* | 7/2005 | Merz et al. | 347/84 |
| 2011/0149000 | A1* | 6/2011 | Albertalli et al. | 347/89 |
| 2012/0098898 | A1* | 4/2012 | Park et al. | 347/85 |

* cited by examiner

*Primary Examiner* — Kristal Feggins
(74) *Attorney, Agent, or Firm* — Fish & Richardson P.C.

(57) ABSTRACT

A fluid ejection device includes a fluid manifold, a substrate coupled to the fluid manifold, and a fluid distribution structure disposed between the fluid manifold and the substrate. The fluid manifold includes a fluid supply chamber and a fluid return chamber. The substrate defines a flow path including a flow path inlet for receiving fluid, a nozzle for ejecting fluid droplets, and a flow path outlet for channeling away unejected fluid. The fluid distribution structure includes a fluid supply channel including a supply inlet fluidically coupled to the fluid supply chamber and a supply outlet fluidically coupled to the flow path. The fluid distribution structure also includes a fluid bypass channel including a bypass inlet fluidically coupled to the fluid supply chamber, a bypass outlet fluidically coupled to the fluid return chamber, and a flow inhibitor between the bypass inlet and the bypass outlet providing a supplemental flow resistance to the fluid bypass channel. The flow inhibitor includes a convergent-divergent throat section.

20 Claims, 4 Drawing Sheets

BYPASS FLUID CIRCULATION IN FLUID EJECTION DEVICES

PRIORITY CLAIM

This application claims the benefit of U.S. Provisional Patent Application No. 61/641,137, filed May 1, 2012. The entire contents of the foregoing are incorporated herein by reference.

TECHNICAL FIELD

This specification generally relates to bypass circulation in fluid ejection devices.

BACKGROUND

In some fluid ejection devices, a flow path including a fluid pumping chamber and a nozzle can be formed in a substrate. Fluid droplets can be ejected from the nozzle onto a medium, such as in a printing operation. The fluid pumping chamber can be actuated by a transducer, such as a thermal or piezoelectric actuator, and when actuated, the fluid pumping chamber can cause ejection of a fluid droplet through the nozzle. The medium can be moved relative to the fluid ejection device, e.g., in a media scan direction. The ejection of the fluid droplet can be timed with the movement of the medium to place a fluid droplet at a desired location on the medium. A fluid ejection device typically includes multiple nozzles, such as a line or an array of nozzles with a corresponding array of fluid paths and associated actuators, and droplet ejection from each nozzle can be independently controlled by one or more controllers. In some cases, at least a portion of any un-ejected fluid can be re-circulated to remove air bubbles, aerated ink, debris, and other contaminants from the substrate.

SUMMARY

In one aspect, the systems, apparatus, and methods disclosed herein feature a fluid ejection device. The fluid ejection device includes a fluid manifold, a substrate coupled to the fluid manifold, and a fluid distribution structure disposed between the fluid manifold and the substrate. The fluid manifold includes a fluid supply chamber and a fluid return chamber. The substrate defines a flow path including a flow path inlet for receiving fluid, a nozzle for ejecting fluid droplets, and a flow path outlet for channeling away un-ejected fluid. The fluid distribution structure includes a fluid supply channel including a supply inlet fluidically coupled to the fluid supply chamber and a supply outlet fluidically coupled to the flow path. The fluid distribution structure also includes a fluid bypass channel including a bypass inlet fluidically coupled to the fluid supply chamber, a bypass outlet fluidically coupled to the fluid return chamber, and a flow inhibitor between the bypass inlet and the bypass outlet providing a supplemental flow resistance to the fluid bypass channel. The flow inhibitor includes a convergent-divergent throat section.

In various implementations, the fluid distribution structure further includes a fluid return channel including a return inlet fluidically coupled to the flow path and a return outlet fluidically coupled to the fluid return chamber. The fluid bypass channel and the fluid return channel can be connected to the fluid return chamber in parallel.

In various implementations, the fluid distribution structure includes an interposer layer, and the fluid bypass channel is a recess in a bottom surface of the interposer layer. The supply inlet, the bypass inlet, and the bypass outlet can be apertures in a top surface of the interposer layer. The aperture of the bypass inlet can be smaller than the aperture of the supply inlet.

In various implementations, a top surface of the interposer layer includes a supply side exposed to the fluid supply chamber and a return side exposed to the fluid return chamber.

In various implementations, the fluid distribution structure is monolithic silicon body.

In various implementations, the fluid bypass channel and the fluid supply channel are connected to the fluid supply chamber in parallel.

In various implementations, the fluid bypass channel is one of a plurality of fluid bypass channels defined by the fluid distribution structure. The plurality of fluid bypass channels can be configured to receive a majority of a fluid flow through the supply chamber.

In various implementations, the fluid bypass channel is arranged to receive fluid from the fluid supply chamber, and the flow inhibitor is configured to regulate a flow rate of the fluid through the fluid bypass channel so as to achieve a predetermined effective thermal resistance. The fluid ejection device can also include an actuator coupled to the substrate to cause ejection of fluid droplets from the nozzle, and a circuit configured to control the actuator. The thermal resistance can be sufficient to dissipate heat generated by the circuit and the actuator during use, such that a temperature rise of the substrate is less than a predetermined threshold. The predetermined threshold can be about two degrees Celsius or less.

In various implementations, the bypass inlet is laterally displaced with respect to the supply inlet on a surface of the fluid distribution structure, such that the bypass inlet is closer to a lateral edge of the surface than the supply inlet.

In another aspect, the systems, apparatus, and methods disclosed herein feature a method for circulating fluid in a fluid ejection device. The method includes a sequence of: flowing a first flow of fluid from a fluid supply chamber to a fluid supply channel, the fluid supply channel being formed on a fluid distribution structure coupled to the fluid supply chamber; flowing the first flow of fluid from the fluid supply channel to a flow path of a substrate coupled to the fluid distribution structure, the flow path including a flow path inlet for receiving fluid, a nozzle for ejecting fluid droplets, and a flow path outlet for channeling away un-ejected fluid; and simultaneously with flowing the first flow of fluid, flowing a second flow of fluid from the fluid supply chamber to a fluid bypass channel, the fluid bypass channel including a flow inhibitor providing a supplemental flow resistance to the fluid bypass channel, the flow inhibitor including a convergent-divergent throat section.

In various implementations, flowing the second flow of fluid includes flowing the second flow of fluid across the flow inhibitor, the flow inhibitor regulating a flow rate of the second flow of fluid. The flow rate of the second flow of fluid can be sufficient to achieve a predetermined thermal resistance.

In various implementations, the second flow of fluid is greater than a portion of the first fluid flow drawn from the flow path outlet when the nozzle operates at a maximum jetting frequency and drop size.

In various implementations, the sequence also includes: flowing a non-ejected portion of the first flow of fluid to a return channel, the return channel being formed in the fluid distribution structure; and flowing the non-ejected portion of the first flow of fluid from the return channel to a return chamber.

Particular implementations of the subject matter described in this specification can be implemented so as to realize one or more of the following advantages. A fluid distribution structure can be provided to circulate a bypass flow of fluid through the printhead module that can be appropriately tuned to promote uniformity in the ejected fluid droplets, and to regulate the temperature of the printhead module.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Many of the layers and features are exaggerated to better show the features, process steps, and results. Like reference numbers and designations in the various drawings indicate like elements.

DETAILED DESCRIPTION

Fluid droplet ejection can be implemented with a fluid ejection device that includes a printhead module. The printhead module can include a substrate configured to eject fluid droplets onto a print medium. A fluid distribution structure can be provided to facilitate circulation of fluid through the printhead module. For example, the fluid distribution structure can be designed to circulate fluid to the substrate for fluid ejection. The fluid distribution structure can also circulate a bypass flow of fluid that can be tuned to promote uniformity in the ejected fluid droplets, and to control the temperature of the printhead module.

Figure 1A:
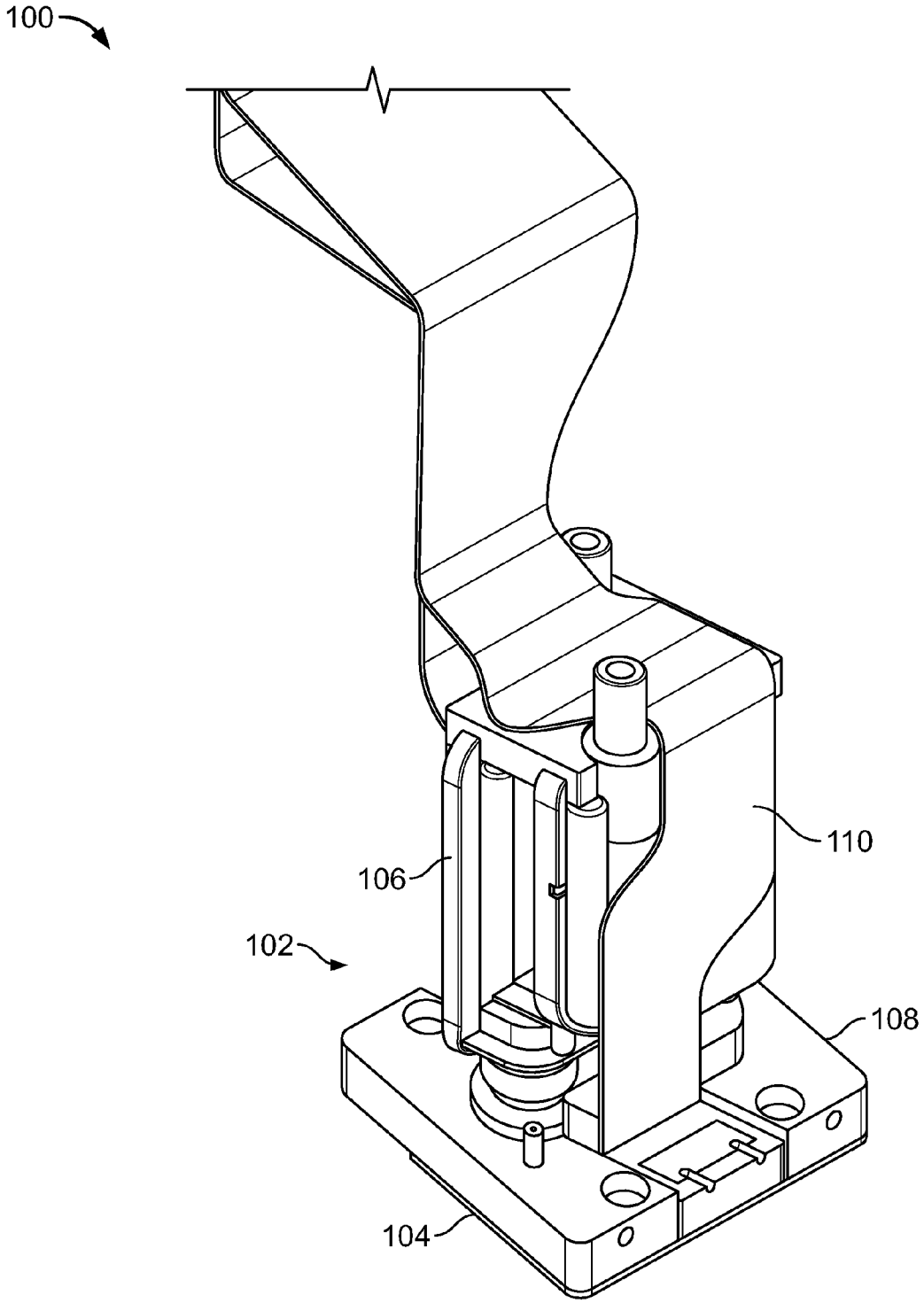
FIG. 1A is a perspective view of a fluid ejection device.
Figure 1B:
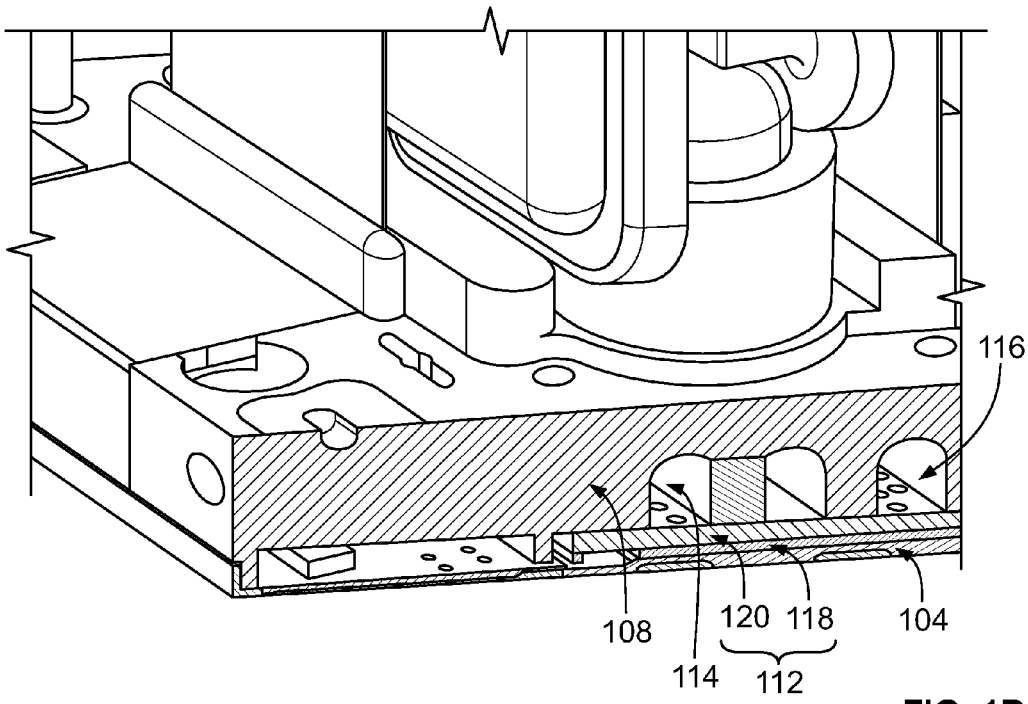
FIG. 1B is a cross-section view, in perspective, of the fluid ejection device shown in FIG. 1A.

FIGS. 1A and 1B show an example fluid ejection device 100. The fluid ejection device 100 includes a printhead module 102 for depositing droplets of fluid on a print medium, and a flexible circuit 106, coupled to the printhead, that electrically connects the fluid ejection device to a printer system (not shown). For example, the flexible circuit 106 can be configured to receive data from a processor of the printer system and to provide drive signals to the printhead module 102.

The printhead module 102 includes a substrate 104 (referred to as a "die" in the present discussion) configured for ejection of fluid droplets onto a print medium. The die 104 and the print medium can undergo relative motion during fluid droplet ejection. The fluid can be, for example, an ink, chemical compound or any other suitable fluid (e.g., biological liquids). The die 104 can include a plurality of microfabricated fluid flow paths, each of which can include a flow path inlet for receiving fluid, a nozzle for ejecting fluid droplets, and a flow path outlet for channeling away un-ejected. U.S. Pat. No. 8,157,352, the entirety of which is hereby incorporated by reference, describes such flow paths. Fluid can be circulated through the flow paths in the die 104 by one or more pumps. However, pumping fluid through the flow paths using pumps can cause disturbances in the fluid flow, and affect printing quality. In some examples, a bypass fluid flow can be used to cause a pressure drop across the die 104 that is sufficient to drive fluid flow through the flow paths, eliminating the need for any pumps. In some examples, the bypass fluid flow can be used to inhibit pressure disturbances that can be caused by an unbalanced distribution of fluid between a fluid supply section and a fluid return section of the printhead module 102. In particular, such pressure disturbances can occur when there is insufficient fluid on the return side when the nozzles are firing at a high rate.

Figure 1C:
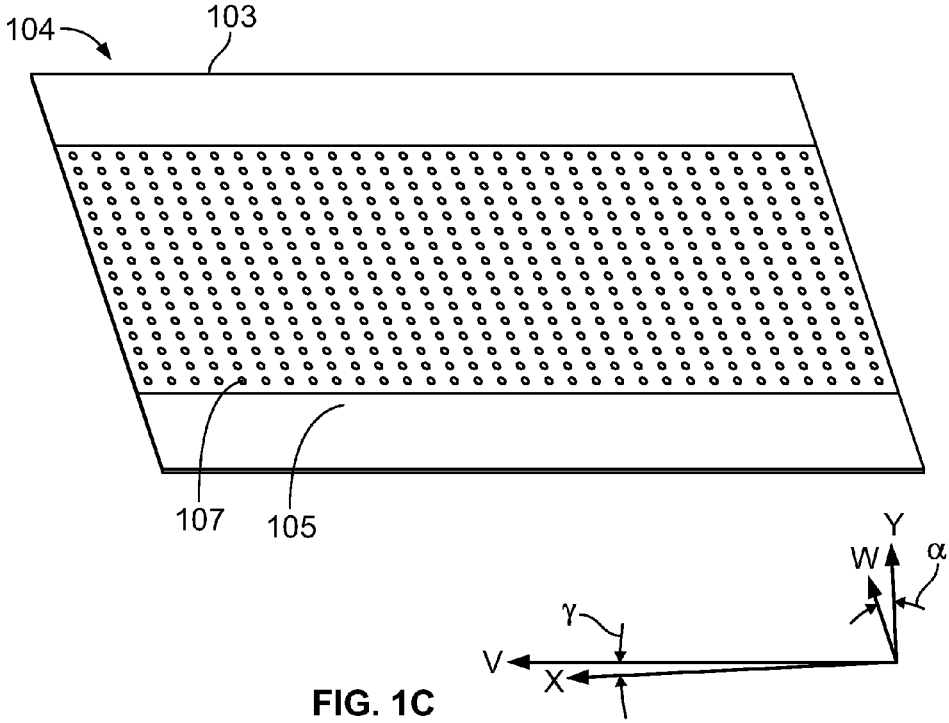
FIG. 1C is a planar bottom view of a printhead die showing the nozzle layer.

The die 104 can be a multi-layered structure including, for example, a flow path body and a nozzle layer. The flow path body can include fluid pumping chambers, and actuators controlled by integrated circuit wafers can be provided for controlling ejection of fluid droplets from the nozzles. The actuators and integrated circuits can generate heat that is dispersed throughout the die 104. FIG. 1C shows the nozzle layer 103 of the die 104. The nozzle layer 103 has a nozzle face 105 that includes nozzles 107. The Y direction is the direction of travel of the print medium relative to the die 104, and the X direction is perpendicular to the Y direction. The long edges of the nozzle layer 103 are oriented in a V direction along the length of the die 104. The V direction is at an angle "$\gamma$" with respect to the X direction. The short edges of the nozzle layer 103 are oriented in a W direction along the width of the die 104. The V direction is at an angle "$\alpha$" with respect to the Y direction.

Returning now to FIGS. 1A and 1B, the printhead module 102 also includes a housing 108, a fluid manifold 110, and a fluid distribution structure 112. The housing 108 can include an inlet passage (not shown) arranged to receive fluid from a fluid reservoir, and to provide the received fluid to the die 104. The fluid manifold 110 includes a fluid supply chamber 114 to receive fluid from the inlet passage of the housing 108, and a fluid return chamber 116 to accommodate any fluid that is not ejected by the nozzles 107. The fluid manifold 110 can be a plastic body with recesses on a bottom surface, e.g., formed by molding or machining, such that when the bottom surface of the fluid manifold 110 is secured to the top of the fluid distribution structure 112, e.g., by adhesive, the volume above the fluid distribution structure 112 in the recesses defines the fluid supply chamber 114 and a fluid return chamber 116. A pressure difference can be created between the fluid supply chamber 114 and the fluid return chamber 116, for example, by using one or more pumps in the fluid reservoir or by changing the fluid level in the fluid reservoir. The pressure difference can cause the fluid to circulate in the printhead module 102.

The fluid distribution structure 112 includes a first interposer layer 118 and a second interposer layer 120. The interposer layers 118 and 120 are located between the fluid manifold 110 and the die 104. The fluid distribution structure 112 can receive fluid from the fluid supply chamber 114, and distribute the fluid to the flow paths in the die 104. The fluid distribution can be performed by one or more supply channels (e.g., supply channels 130, see FIGS. 2B and 2C) provided by the interposer layers 118 and 120. The fluid supply channels can be in fluidic communication with the flow paths in the die 104.

Fluid can be continuously circulated through the flow paths in the die 104 regardless of whether droplets are being ejected out of the nozzles 107. By maintaining a constant fluid flow through the flow path within the die 104 without ejecting droplets from the nozzles 107, the nozzle surface can be kept from drying out during prolonged inactivity. Keeping the nozzle surface wetted during idle time can prevent ink debris from building up on the nozzle surface and affecting printing quality. Fluid that is not ejected out of the nozzles can be re-circulated to the fluid return chamber 116 through one or more return channels (e.g., return channels 140, see FIGS. 2B and 2C) provided by the interposer layers 118 and 120 of the fluid distribution structure 112. For example, the return channels 140 can be in fluidic communication with the flow paths via respective nozzle outlets associated with the flow paths.

In some implementations, the re-circulated fluid collected in the fluid return chamber 116 can be discarded, in the event that the re-circulated fluid includes contaminants (such as air bubbles, dried ink, debris, etc.) that are not easily removable. In some implementations, the re-circulated fluid can be circulated back to the fluid supply chamber 114 and reused in a subsequent fluid ejection operation, along with any fluid newly added to the fluid supply chamber.

In some implementations, one or more filters can be placed at various locations in the in the fluid return chamber 116 and/or in the fluid supply chamber 114, to remove contaminants (such as air bubbles, aerated fluid, dried ink, debris, etc.). In some implementations, a single filter can be placed in the fluid supply chamber 114 (and not in the fluid return chamber 116) to filter the fluid before the fluid enters the fluid distribution structure 112. Using a single filter can help to reduce the complexity and cost of the fluid ejection device 100. In addition, by avoiding the use of a filter in the fluid return chamber 116, air bubbles can be more easily removed or released from the fluid return chamber 116 rather than being trapped by the filter. In some implementations, if a filter is used in the fluid return chamber 116, a release valve (e.g., a hole) can be placed in the fluid return chamber to release the trapped air bubbles.

In addition to fluid flow to and from the flow paths in the die 104, the fluid distribution structure 112 can facilitate a bypass fluid flow through the printhead module 102. As noted above, the bypass fluid flow can be used to inhibit or prevent pressure disturbances in the printhead module 102. Circulating bypass fluid through the printhead module 102 can also help to maintain the components of the die 104 (e.g., the nozzles 107) at a desired temperature. For a particular fluid, a particular temperature or range of temperatures may be desired for the fluid at the nozzles. For example, a particular fluid may be physically, chemically, or biologically stable within a desired range of temperatures. Various properties of the fluid, e.g., viscosity, density, surface tension, and/or bulk modulus that affect print quality can change with the temperature of the fluid. Controlling the temperature of the fluid can help reduce or manage the negative impact the changed properties of the fluid can have on printing quality. Also, a particular fluid may have desired or optimal ejection characteristics, or other characteristics, within a desired range of temperatures. Controlling the temperature of the fluid at the nozzles can also facilitate uniformity of fluid droplet ejection, since the ejection characteristics of a fluid may vary with temperature.

The temperature of the fluid at the nozzles 107 is controlled by controlling the temperature of the nozzle layer 103. To maintain a desired temperature, fluid circulating through the fluid distribution structure 112 (e.g., the un-ejected recirculation fluid and the bypass fluid) can be thermally coupled to the nozzle layer 103. For example, the first and second interposer layers 118 and 120 can include good thermal conductors, such as silicon, rather than poor thermal conductors, such as plastic. Therefore, thermal control of the fluid at the nozzles 107 is provided by regulating the heat exchange rate between the circulating fluid in the distribution structure 112 and nozzle layer 103. The heat exchange rate can depend on many factors, including the temperature and flow rate of the circulating fluid, as well as the heat transfer surface area provided by the fluid distribution structure 112.

In some implementations, fluid temperature can be monitored with a temperature sensor (not shown) placed in, or attached to, the die 104, the fluid supply chamber 114, the fluid return chamber 116, or other suitable locations (shown or not shown). A fluid temperature control device, such as a heater and/or chiller can be placed in the system and configured to control the temperature of fluid. Circuitry can be configured to detect and monitor a temperature reading of the temperature sensor and, in response, control the heater and/or chiller to maintain the fluid at a desired or predetermined temperature. In addition, a flow control device can be used to regulate a pressure difference between the fluid supply chamber 114 and the fluid return chamber 116, thereby regulating the flow rate through the various circulation paths in the printhead module, a faster flow rate can increase the heat exchange between the substrate and the temperature controlled fluid, and thereby bring the temperature of the substrate closer to a desired level.

Figure 2A:
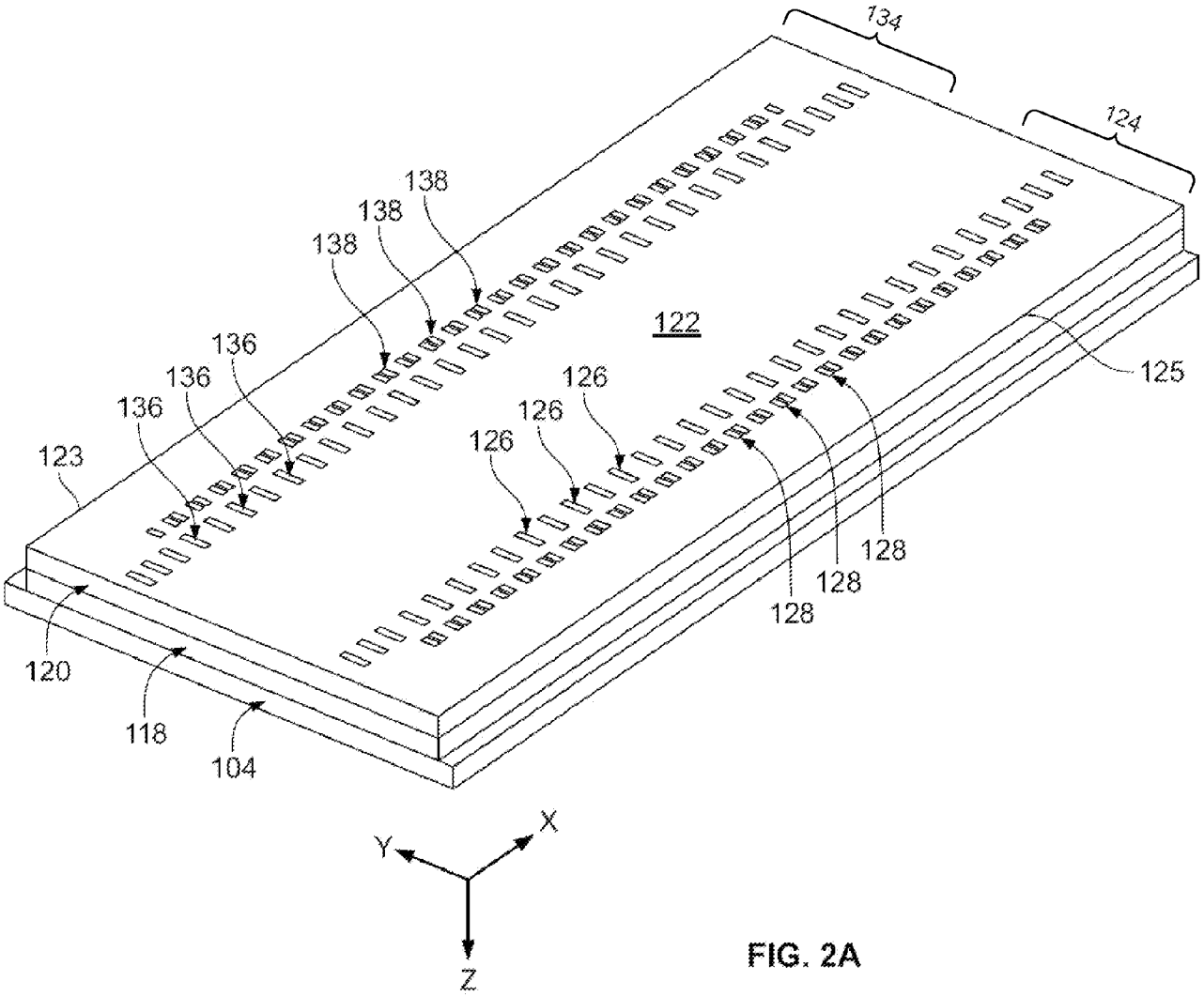
FIG. 2A is an isolated view of the fluid distribution structure of the fluid ejection device shown in FIG. 1A
Figure 2B:
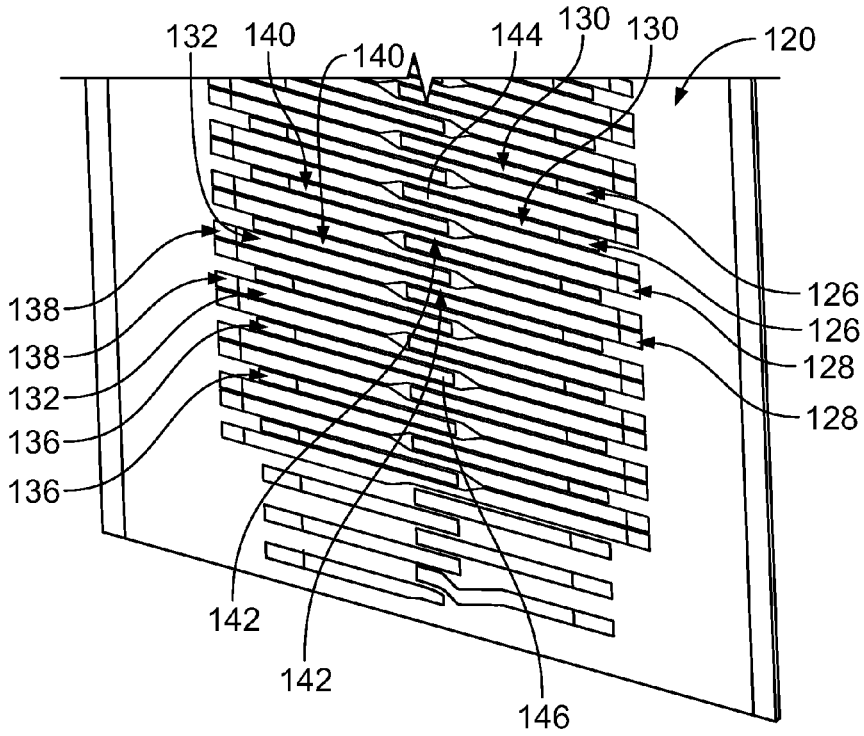
FIG. 2B is a semi-transparent top view of the second interposer layer of the fluid distribution structure shown in FIG. 2A.
Figure 2C:
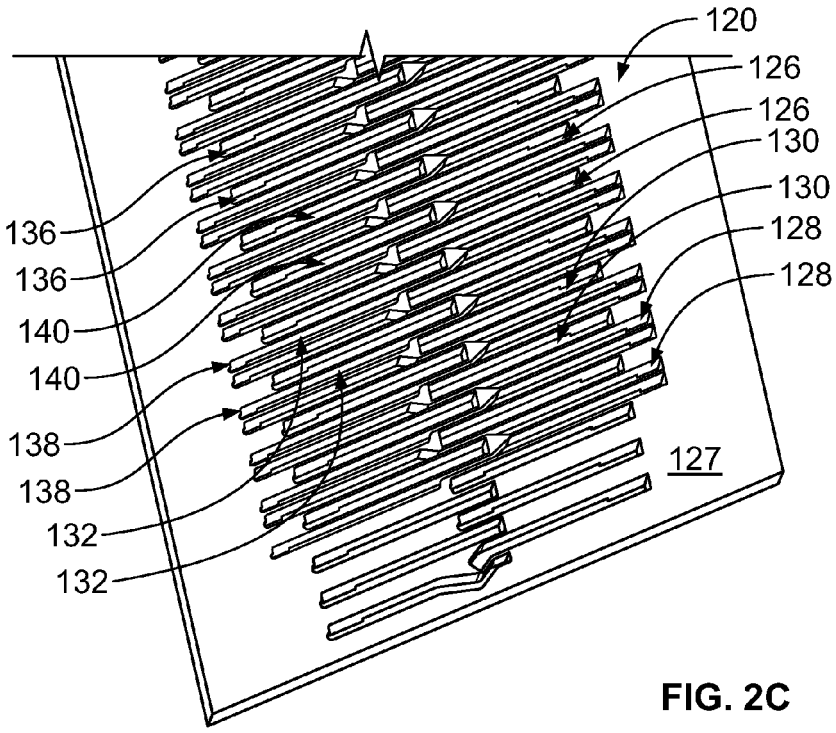
FIG. 2C is a bottom view of the second interposer layer shown in FIG. 2B.

FIGS. 2A-2C provide various views of the fluid distribution structure 112. As shown in FIG. 2A, the first and second interposer layers 118 and 120 can be arranged in a parallel stacked configuration with the die 104. The second interposer layer 120 is positioned at the top of the stack (facing the fluid manifold 110) and the die 104 is positioned at the bottom, with the first interposer layer 118 being disposed therebetween. In this example, the first and second interposer layers 118 and 120 are substantially planar, monolithic silicon bodies having a smaller thickness (in the vertical direction "Z", see FIG. 2A) relative to their width and length (in the lateral directions "Y" and "X", see FIG. 2A). Various flow distribution features can be formed in the first and second interposer layers 118 and 120 using suitable micro-fabrication techniques (e.g., silicon etching).

A top surface 122 of the second interposer layer 120 includes various features that can facilitate fluid distribution. In particular, a supply side 124 of the top surface 122, which is open to the fluid supply chamber 114 when the fluid distribution structure 112 is bonded to the fluid manifold 110, includes a respective array of supply inlets 126 and bypass inlets 128. The array of supply inlets 126 is a first series of apertures positioned in a row extending lengthwise across the top surface 122 on the supply side 124. As shown in FIGS. 2B and 2C, the supply inlets 126 open to a corresponding set of supply channels 130. Each of the supply channels 130 is formed as a recess in a bottom surface 127 of the second interposer layer 120. The supply channels 130 extend laterally widthwise from a location directly below the supply inlets 126 to a central portion of the second interposer layer 120, terminating in supply outlets 144. The first interposer layer 118 can include vertical passageways (not shown) aligned with the supply outlets 144 of the supply channels 130. The passageways of the first interposer layer 118 can lead to the flow paths of the die 104.

The array of bypass inlets 128 is a second series of apertures on the supply side 124. The bypass inlets 128 can be displaced laterally outward relative to the supply inlets 126. For example, the bypass inlets 128 can be closer to a lateral edge 123 of the top surface 122 than the supply inlets 126. The bypass inlets 128 open to a corresponding set of bypass channels 132 recessed into the bottom surface 127 of the second interposer layer 120 (see FIGS. 2B and 2C). The bypass channels 132 extend laterally widthwise across the second interposer layer 120. In this example, the bypass inlets 128 and the supply inlets 126 are arranged in an alternating pattern extending lengthwise across the top surface 122, with the corresponding supply channels 130 and bypass channels 132 being equivocally arranged such that the channels run parallel to one another. The bypass inlets 128 can be smaller apertures than the supply inlets 126. As many as two of the bypass inlets 128 can fit between a pair of the supply inlets 126.

A return side 134 of the top surface 122, which is open to the fluid return chamber 116, is configured similarly to the supply side 124. In particular, the return side 134 includes a respective array of return outlets 136 and bypass outlets 138. The array of return outlets 136 is a first series of apertures extending lengthwise across the top surface 122 on the return side 134. As shown in FIGS. 2B and 2C, the return outlets 136 open to a corresponding set of return channels 140 recessed into the bottom surface 127 of the second interposer layer 120. The return channels 140 extend laterally widthwise from return inlets 146 in a central portion of the second interposer layer 120 to a location directly below the return outlets 136. The first interposer layer 118 can include vertical passageways (not shown) aligned with the return inlets 146 of the return channels 140. The passageways of the first interposer layer 118 can extend from the flow paths of the die 104.

The array of bypass outlets 138 is a second series of apertures on the return side 134. The bypass outlets 138 can be displaced laterally outward relative to the return outlets 136. For example, the bypass outlets 138 can be closer to a lateral edge 125 of the top surface 122 than the return outlets 136. The bypass outlets 138 open to the bypass channels 132 (see FIGS. 2B and 2C). In this example, the bypass outlets 138 and the return outlets 136 are arranged in an alternating pattern extending lengthwise across the top surface 122. The corresponding return channels 140 and bypass channels 132 are equivocally arranged such that the channels run parallel to one another. The bypass outlets 138 can be smaller apertures than the return outlets 136. As many as two of the bypass outlets 138 can fit between a pair of the return outlets 136.

As shown in FIGS. 2B and 2C, each of the bypass channels 132 includes a flow inhibitor 142. The flow inhibitors are positioned between the supply outlets 144 and the return inlets 146. The flow inhibitors can provide a supplemental flow resistance to the bypass channels 132. Thus, the flow inhibitors 142 control the amount of fluid that can flow through the bypass channels 132. In some examples, the flow inhibitors 142 are designed to provide a flow resistance in the bypass channels 132 that is greater than a flow resistance in the supply channels 130 so that fluid from the fluid supply chamber 114 will also flow to the flow paths of the die 104. In this example, the flow inhibitors 142 are convergent-divergent throat sections formed by a narrowed portion in the width of the bypass channels 132. The throat sections allow the flow rate through the bypass channels 132 to be tightly controlled while still providing a relatively large heat transfer surface area.

When designing the bypass channels 132, the desired temperature control range as well as the effective thermal resistance created by the second interposer layer 120 and the circulating fluid can be considered. The "overall thermal resistance" is a measure of the ability of the printhead module 102 to dissipate power with minimal temperature rise. In this case, because the majority of the circulating fluid flows through the bypass channels 132, an "effective thermal resistance" can be determined. The effective thermal resistance represents, in terms of fluid flow through the bypass channels 132, the expected temperature change per unit of heat rate (i.e., power) transferred to the second interposer layer 120 by the nozzle layer 103. The effective thermal resistance can be defined as:

$$R = 1.0/(\text{Density}_{fluid} \times \text{Specific Heat}_{fluid} \times \text{Flow Rate}_{fluid} \times \text{Efficiency})$$

The efficiency is a measure of how well the second interposer 120 exchanges heat with the circulating fluid (i.e., the bypass fluid flow). The efficiency can depend on the thermal conductivity of the fluid, a density of the fluid, a specific heat of the fluid, a flow rate of the fluid, as well as the heat transfer surface area provided by the bypass channels 132, and so on. Mathematically, the efficiency is defined as $$\frac{T_{fluid,out} - T_{fluid,in}}{T_{interposer} - T_{fluid,in}}$$

where $T_{fluid,out}$ and $T_{fluid,in}$ are the temperatures of the fluid exiting and entering the second interposer layer 120, and $T_{interposer}$ is the temperature of the interposer.

The bypass inlets 128, the bypass outlets 138, and the flow inhibitors 142 can be specifically designed or tuned to achieve a flow rate through the bypass channels 132 that is suitable for attaining an efficiency and thermal resistance that are sufficient to maintain the nozzles and other parts of the die 104 at the desired temperature or within the desired temperature range (e.g., about one or two degrees Celsius in temperature rise).

The bypass inlets 128, the bypass outlets 138, and the flow inhibitors 142 can also be designed in view of any minimum bypass fluid flow rate constraints. For example, in some implementations, the bypass fluid flow is maintained at a level this is at least greater than the peak jetting flow (e.g., the flow rate out of the nozzles when all nozzles are ejecting fluid droplets) to prevent backflow in the return channels 140. As another example, the bypass fluid flow may need to be maintained at a certain level to drive the fluid through the flow paths of the die 104.

The use of terminology such as "front," "back," "top," "bottom," "over," "above," and "below" throughout the specification and claims is for describing the relative positions of various components of the system, printhead, and other elements described herein. Similarly, the use of any horizontal or vertical terms to describe elements is for describing relative orientations of the various components of the system, printhead, and other elements described herein. Unless otherwise stated explicitly, the use of such terminology does not imply a particular position or orientation of the printhead or any other components relative to the direction of the Earth gravitational force, or the Earth ground surface, or other particular position or orientation that the system, printhead, and other elements may be placed in during operation, manufacturing, and transportation.

A number of embodiments of the invention have been described. Nevertheless, it will be understood that various modifications may be made without departing from the spirit and scope of the inventions.

What is claimed is:

1. A fluid ejection device, comprising:

a fluid manifold comprising a fluid supply chamber and a fluid return chamber;

a substrate coupled to the fluid manifold, the substrate defining a flow path comprising a flow path inlet for receiving fluid, a nozzle for ejecting fluid droplets, and a flow path outlet for channeling away un-ejected fluid; and a fluid distribution structure disposed between the fluid manifold and the substrate, the fluid distribution structure comprising:

a fluid supply channel comprising a supply inlet fluidically coupled to the fluid supply chamber and a supply outlet fluidically coupled to the flow path; and a fluid bypass channel comprising a bypass inlet fluidically coupled to the fluid supply chamber, a bypass outlet fluidically coupled to the fluid return chamber, and a flow inhibitor between the bypass inlet and the bypass outlet providing a supplemental flow resistance to the fluid bypass channel, the flow inhibitor comprising a convergent-divergent throat section.

2. The fluid ejection device of claim 1, wherein the fluid distribution structure further comprises a fluid return channel comprising a return inlet fluidically coupled to the flow path and a return outlet fluidically coupled to the fluid return chamber.

3. The fluid ejection device of claim 2, wherein the fluid bypass channel and the fluid return channel are connected to the fluid return chamber in parallel.

4. The fluid ejection device of claim 1, wherein fluid distribution structure comprises an interposer layer, and wherein the fluid bypass channel is a recess in a bottom surface of the interposer layer.

5. The fluid ejection device of claim 4, wherein the supply inlet, the bypass inlet, and the bypass outlet are apertures in a top surface of the interposer layer.

6. The fluid ejection device of claim 5, wherein the aperture of the bypass inlet is smaller than the aperture of the supply inlet.

7. The fluid ejection device of claim 4, wherein a top surface of the interposer layer comprises a supply side exposed to the fluid supply chamber and a return side exposed to the fluid return chamber.

8. The fluid ejection device of claim 1, wherein the fluid distribution structure is monolithic silicon body.

9. The fluid ejection device of claim 1, wherein the fluid bypass channel and the fluid supply channel are connected to the fluid supply chamber in parallel.

10. The fluid ejection device of claim 1, wherein the fluid bypass channel is one of a plurality of fluid bypass channels defined by the fluid distribution structure.

11. The fluid ejection device of claim 10, wherein the plurality of fluid bypass channels are configured to receive a majority of a fluid flow through the supply chamber.

12. The fluid ejection device of claim 1, wherein the fluid bypass channel is arranged to receive fluid from the fluid supply chamber, and wherein the flow inhibitor is configured to regulate a flow rate of the fluid through the fluid bypass channel so as to achieve a predetermined effective thermal resistance.

13. The fluid ejection device of claim 12, further comprising an actuator coupled to the substrate to cause ejection of fluid droplets from the nozzle, and a circuit configured to control the actuator, and wherein the thermal resistance is sufficient to dissipate heat generated by the circuit and the actuator during use, such that a temperature rise of the substrate is less than a predetermined threshold.

14. The fluid ejection device of claim 13, wherein the predetermined threshold is about two degrees Celsius or less.

15. The fluid ejection device of claim 1, wherein the bypass inlet is laterally displaced with respect to the supply inlet on a surface of the fluid distribution structure, such that the bypass inlet is closer to a lateral edge of the surface than the supply inlet.

16. A method for circulating fluid in a fluid ejection device, comprising:

flowing a first flow of fluid from a fluid supply chamber to a fluid supply channel, the fluid supply channel being formed on a fluid distribution structure coupled to the fluid supply chamber;

flowing the first flow of fluid from the fluid supply channel to a flow path of a substrate coupled to the fluid distribution structure, the flow path comprising a flow path inlet for receiving fluid, a nozzle for ejecting fluid droplets, and a flow path outlet for channeling away unejected fluid; and simultaneously with flowing the first flow of fluid, flowing a second flow of fluid from the fluid supply chamber to a fluid bypass channel, the fluid bypass channel comprising a flow inhibitor providing a supplemental flow resistance to the fluid bypass channel, the flow inhibitor comprising a convergent-divergent throat section.

17. The method of claim 16, wherein flowing the second flow of fluid comprises flowing the second flow of fluid across the flow inhibitor, the flow inhibitor regulating a flow rate of the second flow of fluid.

18. The method of claim 17, wherein the flow rate of the second flow of fluid is sufficient to achieve a predetermined thermal resistance.

19. The method of claim 17, wherein the second flow of fluid is greater than a portion of the first fluid flow drawn from the flow path outlet when the nozzle operates at a maximum jetting frequency and drop size.

20. The method of claim 16, further comprising, flowing a non-ejected portion of the first flow of fluid to a return channel, the return channel being formed in the fluid distribution structure; and flowing the non-ejected portion of the first flow of fluid from the return channel to a return chamber.

* * * * *